US005570597A

United States Patent [19]

Bongini et al.

[11] Patent Number: 5,570,597

[45] Date of Patent: Nov. 5, 1996

[54] SIMPLIFIED FRONT LOADING LAUNDRY WASHING MACHINE

[75] Inventors: Dino Bongini, Fabriano; Sandro Duri, Fiuminata; Andrea Stopponi, Matelica, all of Italy

[73] Assignee: Merloni Elettrodomestici S.p.A., Fabriano, Italy

[21] Appl. No.: 346,154

[22] Filed: Nov. 29, 1994

[30] Foreign Application Priority Data

Nov. 30, 1993 [IT] Italy ..... TO93A0910

[51] Int. Cl.[6] ..... D06F 21/04; D06F 37/10; D06F 37/22; D06F 39/02

[52] U.S. Cl. ..... 68/17 R; 68/23.2; 68/139; 68/210

[58] Field of Search ..... 68/17 R, 23.1, 68/23.2, 24, 139, 140, 210; 134/93; 210/364, 365

[56] References Cited

U.S. PATENT DOCUMENTS

| | | | |
|---|---|---|---|
| 2,352,363 | 6/1944 | Bassett, Jr. | 68/23.1 |
| 2,931,505 | 4/1960 | Winslow | 68/23.1 X |
| 2,960,780 | 11/1960 | Stillwell, Jr. . | |
| 3,595,036 | 7/1971 | Depas | 68/17 X |

FOREIGN PATENT DOCUMENTS

| | | | |
|---|---|---|---|
| 242652 | 9/1965 | Australia | 68/23.1 |
| 630643 | 7/1963 | Belgium | 68/210 |
| 112723 | 1/1969 | Denmark | 68/17 R |
| 0406115 | 1/1991 | European Pat. Off. . | |
| 1287987 | 2/1962 | France | 68/24 |
| 1188546 | 3/1965 | German Dem. Rep. | 68/139 |
| 1585595 | 9/1970 | Germany . | |
| 386373 | 7/1960 | Switzerland . | |
| 699794 | 11/1953 | United Kingdom | 68/24 |
| 1155774 | 7/1966 | United Kingdom . | |
| 1414294 | 11/1975 | United Kingdom | 68/23.2 |
| 2029862 | 3/1980 | United Kingdom . | |
| 2096649 | 10/1982 | United Kingdom . | |
| 2182353 | 5/1987 | United Kingdom . | |

*Primary Examiner*—Philip R. Coe
*Attorney, Agent, or Firm*—Herbert Dubno

[57] ABSTRACT

A front loading laundry washing machine, whereby the group constituted by the tub, the basket and by the balancing masses of the machine is suspended within the cabinet in a position being substantially higher than that of normal front loading washing machines, so as that at least the aperture of the frontal wall of the cabinet can be found at a height substantially higher than that of normal front loading washing machines.

15 Claims, 5 Drawing Sheets

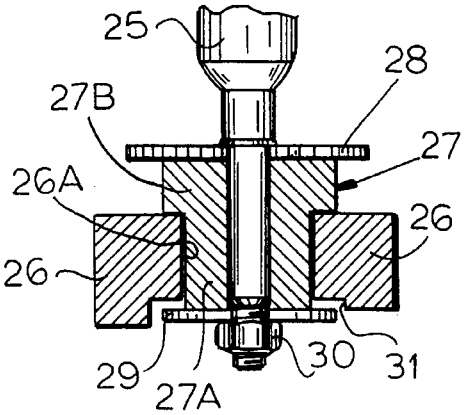
FIG.5A
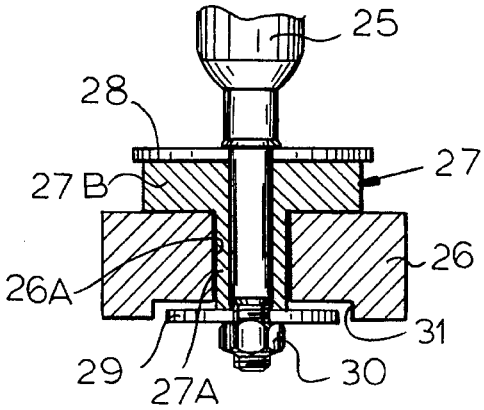
FIG.5B
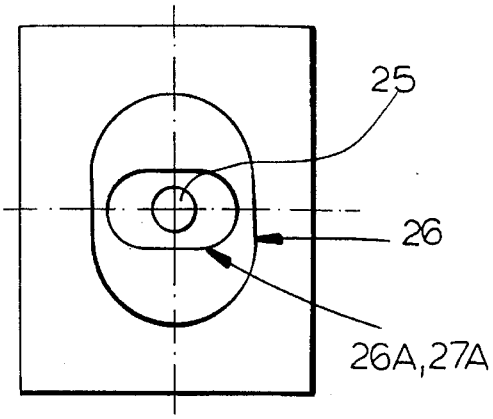
FIG.5C
FIG.6
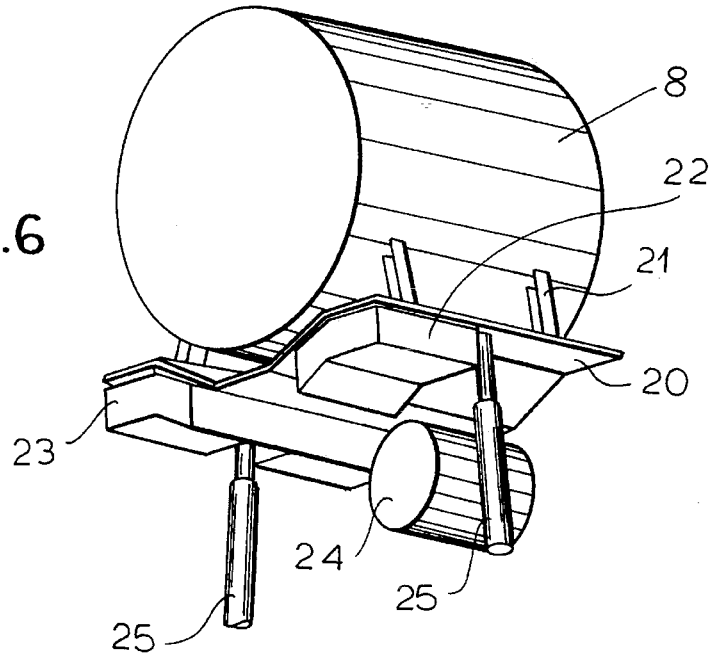

SIMPLIFIED FRONT LOADING LAUNDRY WASHING MACHINE

FIELD OF THE INVENTION

The present invention relates to a front loading laundry washing machine.

BACKGROUND OF THE INVENTION

Domestic laundry washing machines can be of the top loading or front leading type, according to the arrangement of the opening for the loading and unloading of the clothes from the machine. The existence of two such categories of machines is due to various factors, including the availability of space within the house, aesthetic needs and, last but not least, the simple preference of the user for one type of laundry washing machine compared to the other.

Generally front-loading laundry washing machines are made up of a parallelepiped cabinet containing a tub assembly. The tub assembly can include a container for the washing liquid, or a tub in a strict sense of the word, within which a basket for the laundry is mounted in a way so as to enable it to rotate around a substantially horizontal axis. In the case of front loading machines the basket, of a cylindrical form, has an opening in its frontal wall, substantially coaxial with two openings respectively present on the frontal wall of the tub and of the cabinet of the machine. The laundry is thus loaded and unloaded in relation to the basket through these openings such that, during the functioning of the machine, the opening of the tub is closed by a door, generally of a circular form.

Inside the cabinet, appropriate means are provided for producing the rotation of the basket (electric motor, belts and pulleys). Means are also provided for the supply and the discharge of the washing liquid from the tub (hydraulic conduits and one or more pumps) and a distributor device for washing agents, able to supply over determined times of the operating cycle of the laundry washing machine the detergent or possible additives inside the tub. The distributor can have a drawer-like form with a number of distinct compartments and can be housed in the upper part of the cabinet of the machine. The tub assembly has appropriate equalizing or balancing masses, generally constituted by one or more counterweights of cement, or cast iron, or inert material, and by the motor itself of the laundry washing machine. This counterweighted assembly is centrally suspended inside the cabinet of the machine by means of suspension and/or support units.

The motor is usually fixed beneath the washing tub, while the cited counterweights and suspension/support elements are arranged at appropriate points, between the tub and the cabinet of the machine, i.e. in the frontal and/or upper, and/or rear part of the washing tub.

The frontal counterweight can for example be composed of a toroidal element in cast iron, or cement, or inert material, fixed to the tub around its frontal opening. The manner of fixing the frontal counterweight varies from traditional solutions such as screws and nuts, to more evolved solutions wherein the counterweight is fixed by means of the closure rim off the tub with the frontal bottom. In any case it is the tub that supports the ballast and thus it must be provided with suitable brackets. In other known machines (see for example the document GB-A-2,096,649) a frontal drawn counterflange is provided that, together with horizontal cross members and a rear bottom, forms the load bearing structure of the tub. In this case a cement or inert material mass is frontally suspended from the counter flange. This arrangement necessitates a frontal counterflange of a very heavy material, so as to ensure the required sturdiness.

The upper counterweight is generally constituted by one or more masses of cement or inert material, fixed, in a yoke fashion, to the upper cross member of the tub assembly by ray of a sheetplate bridge (see the previously cited GB-A-2,096,649). In this way, the rear counterweight may be constituted by a toroidol element in cement or inert material fixed to the rear cross section of the tub, or by a mass anchored to said upper cross member of the tub assembly. In other known configurations it is the same cross member of the tub, in an appropriate material and weight (usually cast iron) that forms the rear counterweight.

The tub assembly, including associated elements and balancing masses, constitutes an oscillating group, that, as said, is suspended and supported by suitable elastic and damping elements. Such elements are generally constituted by springs above, and shock absorbers below, fixed between the cross members or suitable brackets of the tub and the cabinet of the machine.

The distribution of the various aforementioned components inside the cabinet of the front leading laundry washing machine is, according to above prior art, the source of several problems.

There are for example the abovementioned constructive problems, according to which a plurality of means are to be provided for the fixing of the counterweights in numerous established points of the tub assembly, and of means, such as cross members, for strengthening the same group.

There are above all drawbacks for the user, that must bear a certain discomfort in the loading and unloading operations of the laundry; in fact, according to the prior art, in front loading machines the opening for loading is in the part substantially intermediate of the front of the machine, or in a position which is not at all ergonomic regards height.

There have been proposed for this purpose laundry washing machines in which the frontal load opening and the relative door are slightly raised if compared to the normal, but without determining substantial advantages regarding the problems mentioned above. Such compromising solutions have been obtained by simply making the frontal opening of the cabinet and of the tub slightly higher, but without any further substantial modifications to the group and to the location of the various components cited above.

For facilitating the frontal loading the size of the load opening has also been altered, by enlargement. This arrangement has been found to be unsatisfactory. In fact, the greater the size of the opening of the basket, the less is the capacity of its frontal wall in its function of containing, or preventing, the exiting of clothes, once the latter have been introduced in the basket or on the moment of opening the porthole.

OBJECTS OF THE INVENTION

The principle object of the present invention is to provide an improved front loading laundry machine avoiding drawbacks of the prior art. Another object of the invention is to provide the front loading washing machine facilitating an operator to perform loading and unloading.

SUMMARY OF THE INVENTION

These and other aims, that will result in being clear from the following of the description, are reached according to the present invention of a front loading laundry washing machine, comprising a cabinet, the dimensions of which are in the order of those normally used in front loading washing machines, a washing tub housed within said cabinet, a laundry basket, arranged in the tub so as to enable its rotation around a substantial horizontal axis, the cabinet, the tub and the basket each having an aperture in the respective frontal walls for allowing the loading and unloading of the laundry from inside the basket, the three apertures being aligned so as to allow the loading and unloading of laundry from inside the basket and, during the functioning of the machine, are obstructed by way of door, one or more balancing masses elastically suspended within the cabinet for stabilizing the machine during the rotation of the basket, whereby the group constituted by the tub, the basket and by the balancing masses is suspended within the cabinet in a position substantially higher than that of normal front loading washing machines, (i.e. close to the top of the machine), so that at least the aperture of the frontal wall of the cabinet can be found at a height substantially higher than that of normal front loading washing machines of the European type.

BRIEF DESCRIPTION OF THE DRAWING

The above and other objects, features, and advantages will become more readily apparent from the following description, reference being made to the accompanying drawing in which:

FIGS, 5A, 5B and 5C show different sections of a possible fixing system of the suspended elements of the tub assembly of the front loading laundry washing machine according to the present invention; and FIG. 6 is a schematic perspective view of a preferred embodiment of the oscillating group of the front loading laundry washing machine according to the present invention.

SPECIFIC DESCRIPTION

In its essence, the present invention is based on the recognition of the fact that the lowering of the barycenter of the oscillating group, coupled to a contemporary raising of the position of the same group by a value being substantially equal to the lowering of the barycenter, allows for achieving the aforementioned objects.

Such solution, moreover, maintains the barycenter of the oscillating group in a position substantially equivalent to that of the present machines. By lowering the barycenter of the group according to the invention, if compared to a group of the type of the prior art, and then placing the group above the prior art group, has as a consequence that the barycenter of both kinds of machine is to be found, in substance, at the same height (taking as a reference the cabinet of the laundry washing machine, and with parity of its size), notwithstanding the shift of static masses and dynamic forces.

The masses that combine to mainly position the cited barycenter, besides the but, basket and motor, are the counterweights. According to the invention for lowering the barycenter of the oscillating group, all counterweights are located below the tub, thus also allowing for the elimination of substantial obstacles in the area of the opening of the basket and in the area above the tub.

In such a way, as there are no needs for a frontal counterweight, space in the front part of the machine is recovered. Therefore the distributor for washing agents can be housed in the space freed at the front or the machine and can be eliminated from the upper part of the cabinet of the machine. Furthermore, the space recovered in the frontal part of the cabinet allows for locating there other functional/operative elements of the machine and of a supporting surface for simplifying the laundry loading/unloading operations, without however causing the overall dimensions of the machine to exceed those of the European type machines (e.g. height cm. 85, depth cm. 55, width cm. 59) according to the prior art. The entire oscillating group may therefore be displaced upwards by a substantial value, with the consequent raising of the opening of the loading door, towards the most ergonomic position possible for a front loading machine, without having the drawbacks from a functional point of view (instability of the machine while spinning), thanks to the downward displacement of the barycenter of the oscillating group.

Figure 1:
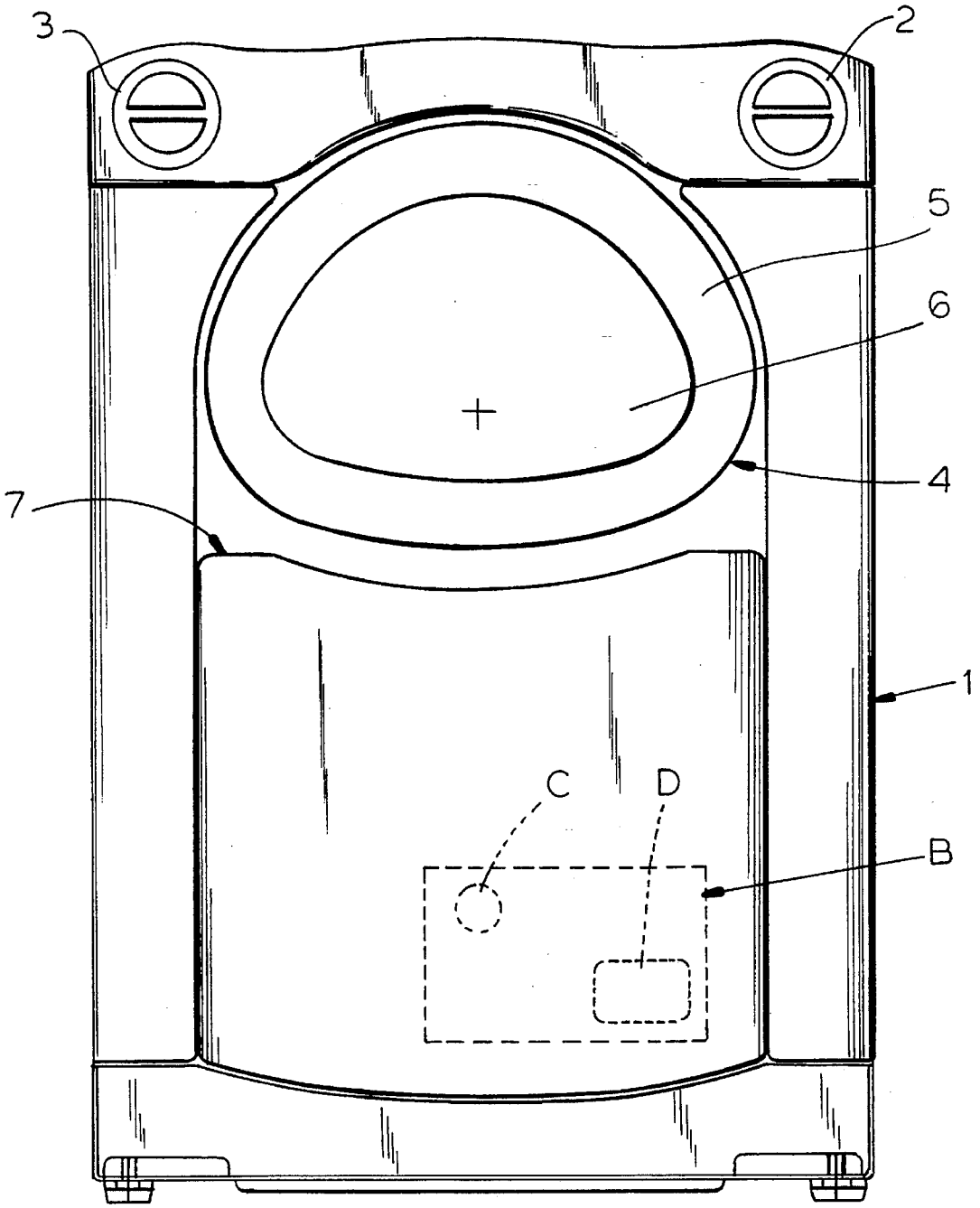
FIG. 1 is a schematic view showing a frontal view of a front loading laundry washing machine according to the present invention.

FIG. 1, shows the cabinet 1 in sheetplate of the laundry washing machine, of substantially parallelepiped form and of a size in the order of the known front loading laundry washing machine of the European type (e.g. height cm. 85, depth cm. 55, width cm. 59). A knob 2 for the selection of the washing cycle and a knob 3 for the election of temperatures of the washing liquid are provided. Other command devices and displays (such as buttons, switches, lights, etc.) have not been represented in the figure for simplicity. The loading door 4 of the machine is found at the upper half of the cabinet 1. The door 4 has a generally vertically compressed form (approximately triangular or elliptic) and a width substantially greater than that of common circular portholes of the laundry washing machines according to the known art. The door 4 includes a frame 5 and a transparent central part 6, for example of glass or plastic material, set inwardly towards the interior of the cabinet. The door 4 is furthermore equipped with hinges and with a door stopping device (these elements are not represented inasmuch as they are known in the art), for its opening in lateral sense.

With reference number 7 a support surface is shown, below the door 4 and being substantially central if compared to the frontal wall of the cabinet of the machine. The surface 7 can assume two working positions, as will be discussed.

Figure 2:
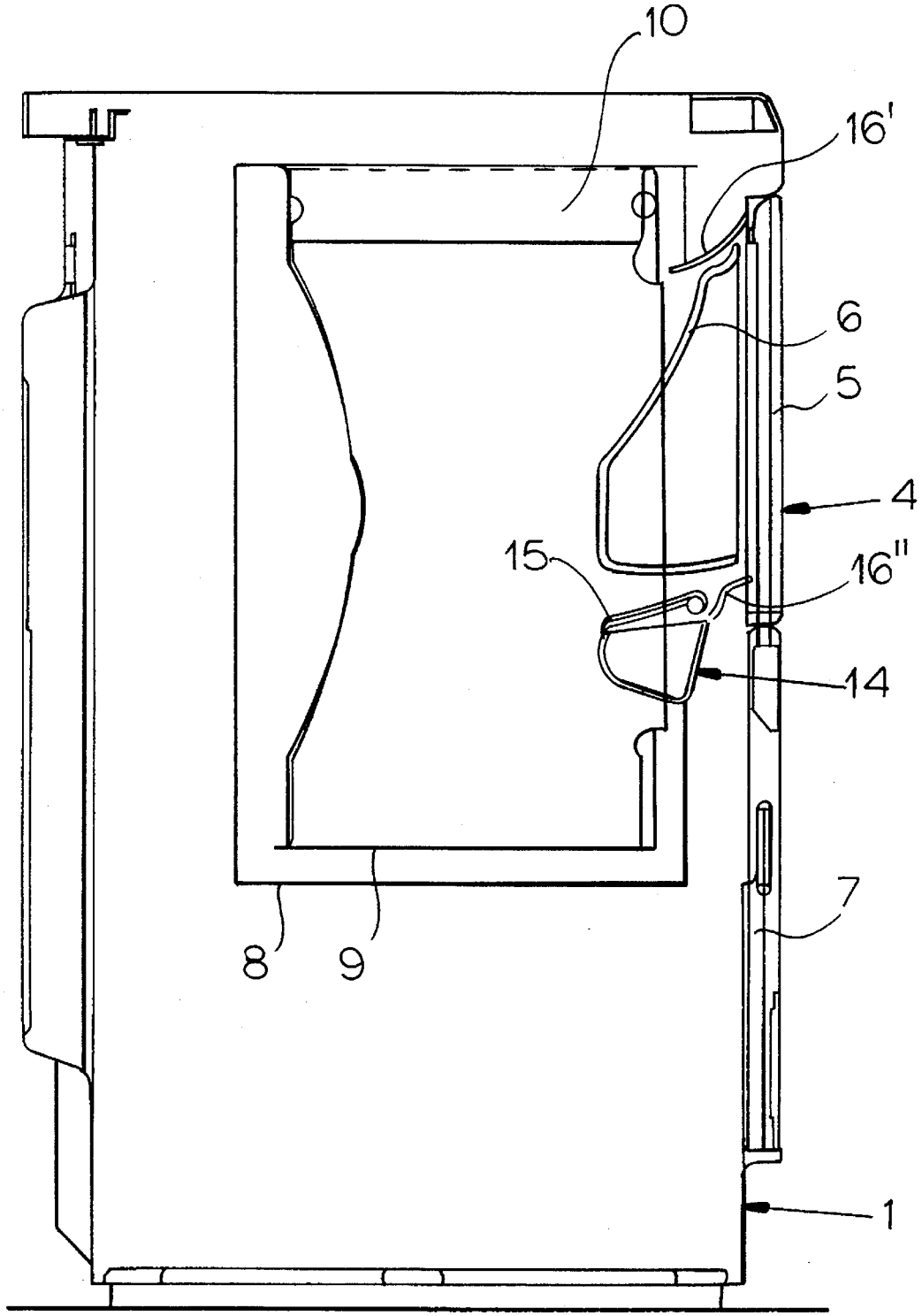
FIG. 2 is a schematic partial lateral section of a front loading laundry washing machine according to the present invention, in a first condition of use.
Figure 3:
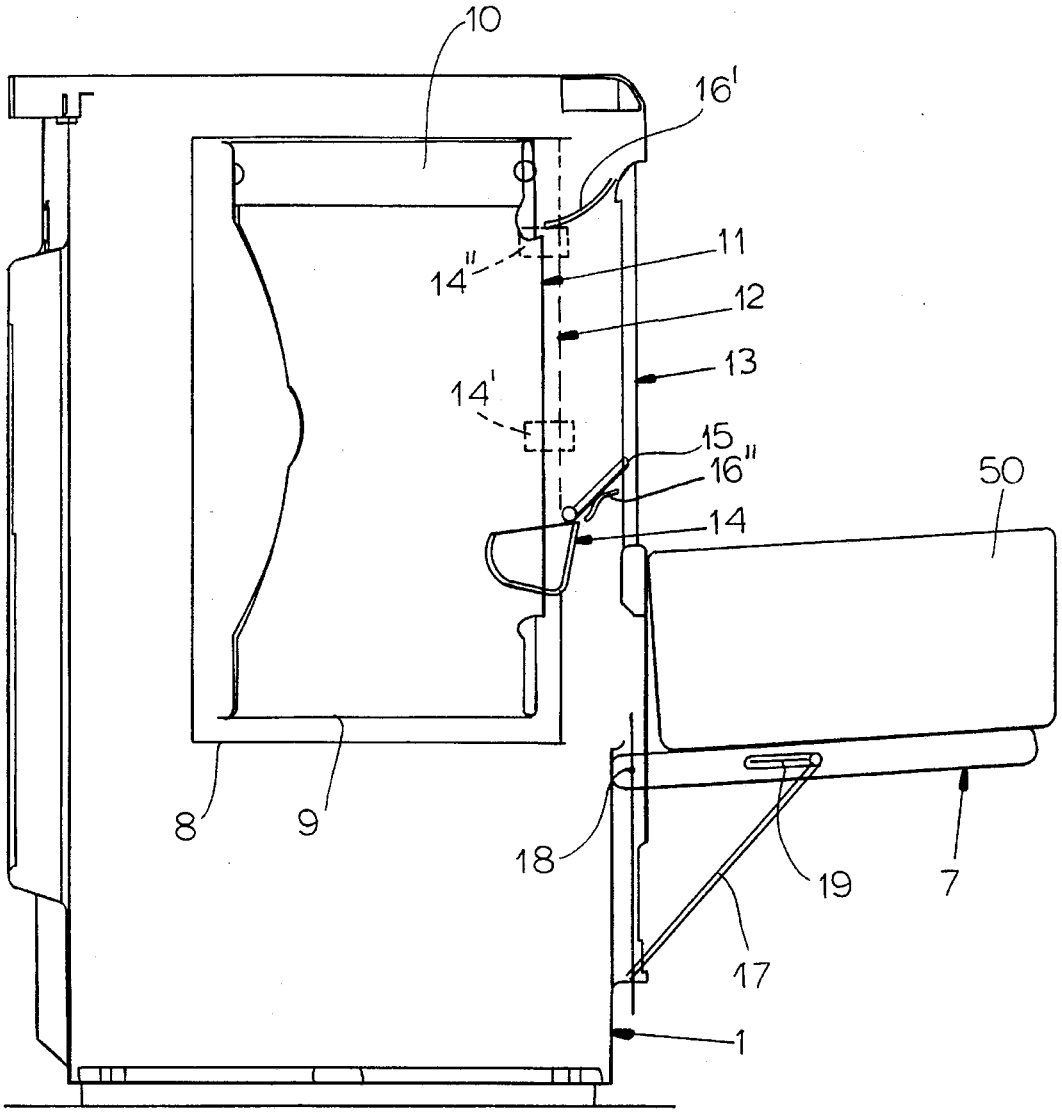
FIG. 3 is a schematic partial lateral section of a front loading laundry washing machine according to the present invention in a second condition of use.

In FIGS. 2 and 3 the laundry washing machine is shown in a vertical section, respectively in closed door and open door conditions (in FIG. 3 the door is not represented for greater clarity).

Figure 4:
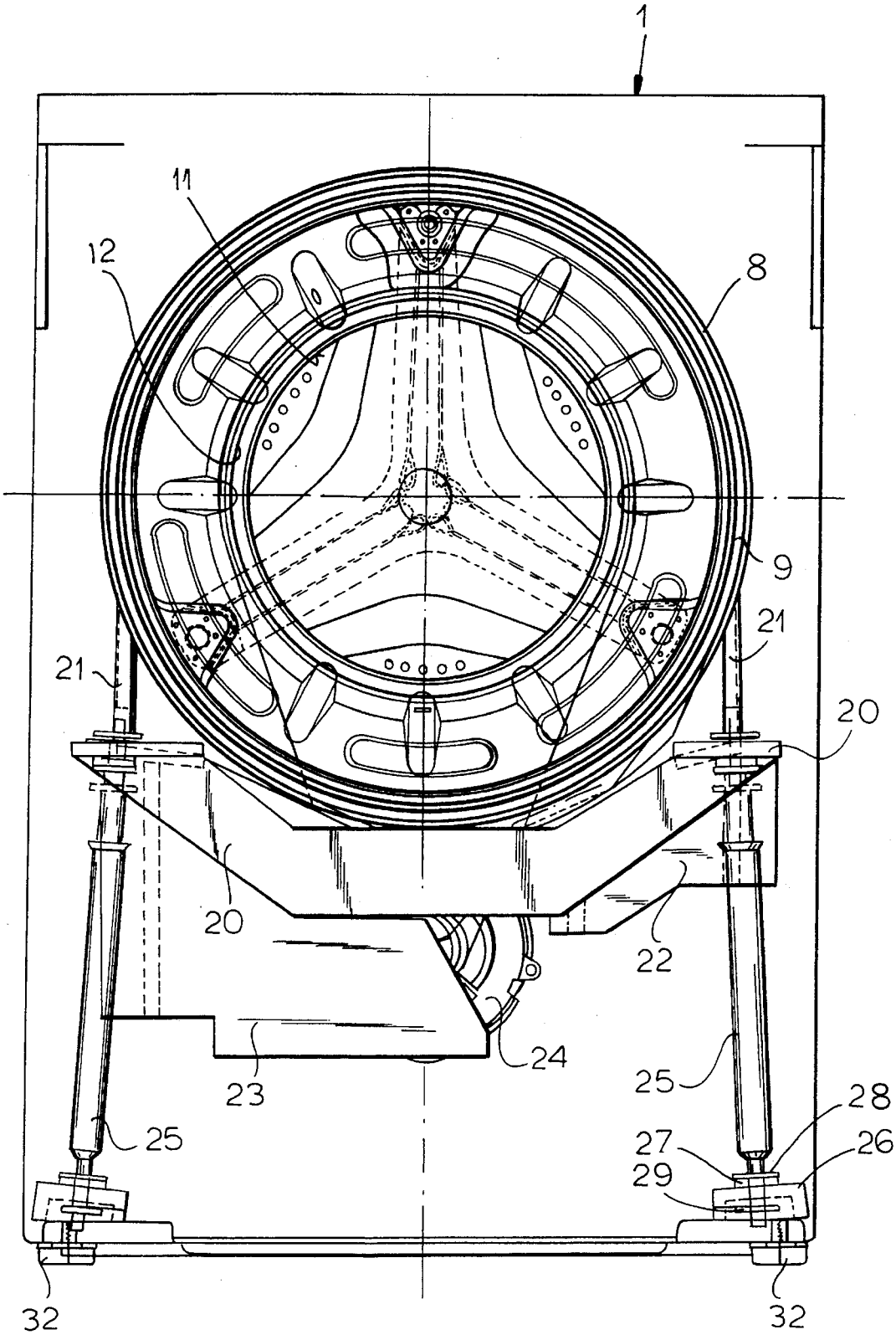
FIG. 4 is a schematic partial frontal section of a front loading laundry washing machine according to the present invention.

The washing tub of the machine 8 receives a basket 9 mounted in a known way, with a horizontal rotation axis and placed in movement by way of an electric motor 24 (FIG. 4). The basket contains an element 10 forming a dragging element facilitating the movement of the laundry inside the basket 9. A circular opening 11 is provided in the frontal or end wall of the basket 9 and is aligned with an opening 12 in the frontal wall of the washing tub 8 also aligned with an opening 13 present in the frontal wall of the cabinet 1 of the laundry washing machine.

From FIGS. 1–3 it can already be noted how the tub-basket assembly and the openings 11–13 are substantially raised as compared to a front loading laundry washing machine of the known type.

Reference number 14 indicates the body of a distributor for washing agents, that is integral with the frontal wall of the washing tub 8; in particular the body 14 is fixed on the lower edge of the opening 12, in order to directly protrude towards the interior of the basket 9. In the represented case the distributor 14 has in its upper part a flap 15. A bellows seal 16 is provided and the upper part 16' of the seal extends between the opening 13 of the cabinet 1 and the opening 11 of the basket 9, through the opening 12 of the tub 8. The lowerside 16" of the seal instead extends between the opening 13 of the cabinet 1 and the body 14 of the washing-agent distributor.

From a comparison between the FIGS. 2 and 3 it an also be noted that the surface 7 has an articulation system 17-18-19, also it in itself known, that allows the surface 7 itself to assume two different positions:

- a rest position, (FIG. 2), in which the surface 7 is folded and housed in a suitable seat, in order that it does not exceed the frontal dimensions of the cabinet 1; and
- a work position (FIG. 3), in which the surface 7 is raised and can thereby realize an ideal support for a container 50 of clothes to be loaded or unloaded from machine.

In the seat of the surface 7, for example in the area shown with B in FIG. 1, doors are located for an easy access to the functional elements of the machine. For example at C the door is shown that gives access to the filter of a pump, for its periodic cleaning, while at D the door is shown that gives access to an electronic control card of the laundry washing machine, in the case of maintenance. For having easy access to such doors, that are normally hidden from view, it is sufficient to bring the surface 7 in the position of FIG. 3.

The washing agents distributor according to the invention may be made in any known form and by any technique.

For example it can be provided with at least one passage coming from the supply tube of the water mains to the machine and connected to the body 14. In the underside of such body 14, in the portion that protrudes inside of the basket 9, openings sufficiently small for containing the detergent in powder can be provided, but permeable to the mixture that is formed in following the dilution of the detergent with the water coming from the passage.

Thus, upon the opportune moment of the washing cycle, the programming device of the machine will allow from the opening of a solenoid valve, in such a way that a stream of water penetrates the body 14 and that the water-detergent mixture consequently formed, can flow directly in the basket 9 through lower openings.

Moreover it is clear that other forms and solutions are possible for the practical realization of the washing agents distributor in the machine according to invention. For example the discharge of washing agents could be determined by overflow, by supplying the body 14 with water until the water-detergent mixture in the meantime formed reaches a certain level and flows from the body 14 directly in the basket 9. In this case, for example, the opening of the flap 15 could be caused by the actual pressure of the water inside the body 14.

In the preferred, but not exclusive, embodiment of the invention, the washing agents distributor is a type of "pouch" integral with the frontal wall of the washing tub and directly facing the interior of the basket. In agreement with such inventive idea, and to the abovementioned embodiment, the detergent can directly and swiftly reach between the clothes, preferably already diluted and of an optimal concentration. In this way the risk that the powder detergent will accumulate in the lower space between the tub and the basket is eliminated. In other words, according to the invention, the washing agents distributor 14 has a function being very similar to that obtained with the use of containers, or so called "balls", which are inserted in the basket together with the clothes. This function is moreover increased by the fact that, according to the invention the detergent is not necessarily activated in the course of the first loading of water in the but, as is the case with the balls.

The position of the washing agents distributor 14 is similarly convenient for the charging of the detergent and for the periodic cleaning of its container. For this purpose, at least a part of which is advantageously removable. In fact another advantage of the positioning of the distributor 14, directly facing the interior of the basket, is that in case of errors in the charging of the detergent, said detergent will tend to fall inside the machine, and not on the floor as is the case with the machines according to the known art.

The particular location of the washing agents distributor 14, also remarkably simplifies the loading and unloading of the clothes.

The known art has the problem of containing the clothes, which tend to fall out of the basket, once the door is open or during the loading phases of the machine. According to the invention, it is possible to realize a very large loading opening 11, without such drawbacks and thus allowing an easy loading and unloading of the laundry: the lower part of such opening 11 is obstructed by the washing agents distributor 14 (or by another functional particular), that acts as a containing element of the exiting of the laundry, while the upper part of the opening 11 is instead obstructed, in use, by the door 4–6. It is specified for this purpose that, from tests carried out, on the front loading laundry washing machine according to the invention, the ratio between the diameter of the opening 11 and the diameter of the basket 9 may be in the order of about 0.75, while in machines actually available on the markets, the ratio between the diameter of the opening of the basket and that of the basket is in the order of 0.55.

A further advantage of the arrangement of the washing agents distributor is that there are no problems in opening the door even in the presence of water inside the tub, naturally in respect of safety regulations, because the body 14 (or of other eventual functional particular) realizes in practice a "bank", that is higher than the lower edge of the opening of the tub, minimizing the risk of liquid loss.

It is also to be considered that the position of the body 14 and the "increased" dimensions of the loading openings, there is a substantial advantage of the invention because the loading and unloading of clothes is greatly simplified. The openings 11–13 are substantially arranged in the upper half of the frontal wall of the cabinet 1 of the machine, in proximity of the top of the latter, and therefore in a position being as ergonomic as possible for a front loading machine.

As said, this is obtained by way of a substantial upward displacement of the oscillating group of the laundry washing machine according to the invention and a simultaneous lowering of the barycenter of the same. In FIG. 4 the means that allow such raising are in fact illustrated.

In FIG. 4, a lower base 20 of a metallic material has a depth substantially similar to that or the tub 8. The base 20 is integral to the washing tub 8 by way of suitable brackets, two of which are visible with 21.

To the lower part of the metallic base 20, counterweights 22, 23, are anchored with known techniques.

An electric motor 24 is similarly fixed to the base 20, for imparting to the basket 9, through a belt and a pulley, the necessary rotation. As can be noted the motor 24 is centrally fixed, if compared to the tub 8 and the base 20. Clearly, to the base 20, besides the motor 24, other functional elements of the laundry washing machine (such as a washing and/or recycle and/or discharge pump, an electromechanical pressure switch, etc.) can be advantageously anchored.

The base is supported by a pair of loadbearing shock absorbers 25 of a length of such to allow the desired raising of the tub assembly.

Such loadbearing shock absorbers 25 are elastically fixed between the base 20 and the cabinet 1 of the machine. FIGS. 5A–5C are different sections of a possible embodiment of the anchorage system of the shock absorbers 25 to the cabinet of the machine. In these FIGS., a support element 26 integral to the bottom of the cabinet i is shown and has a through hole 26A of a substantially elliptic section, a rubber spacer 27 has a shank 27A, also of an elliptic section, inserted in the opening 26A of the support element 26. The head 27B of the spacer 27 rests on the upper surface of the element 26, two metallic disks 28, 29 are provided on opposite sides and with a fixing bolt 30 holds the assembly together.

The rubber spacer 27 similarly has a through hole in which the lower end of the shock absorber 25 is inserted. The two disks 28 and 29 are placed at the upper and lower end of the spacer 27, in order that the bolt 30 realizes the fixing of the group. The disk 29, that is housed in a lower recess 31 of the support 26, allows the anchorage of the shock absorber 25.

The particular elliptic form of the opening 26A and of the shank 27A, as can also be seen from comparison between FIGS. 5A and 5B, has the function of allowing controlled oscillations in a lateral sense to the shock absorbers 25, and therefore to the tub assembly, though ensuring the necessary assembly elasticity; in particular the greater section of the opening 26A and of the shank 27A (part A of FIG. 5) allows oscillatory movements of the shock absorbers 25 being wider in a lateral direction, while the smaller section of such elements (part B of FIG. 5) prevents excessive oscillatory movements of the shock absorbers in the direction of the frontal and rear walls of the cabinet.

A similar fixing system to that illustrated in FIGS. 5*b* and 5*c*, but of a more rigid type, is also provided for the anchorage of the upper part of the shock absorbers 25 to the base 20. The sizing, the weight and the anchorage position of counterweights 22 and 23 on the base 20 and the number and the fixing positions of the shock absorbers 25 can be selected in function of the operative characteristics of the machine, and in particular as a function of the maximum laundry load allowed and of the maximum speed that the basket can reach during its rotation.

As said, the counterweights 22 and 23 are fixed in the lower part of the tub, in order to obtain the substantial lowering of the barycenter of the oscillating group and to enable at the same the raising of the group itself by a value substantially equal to the lowering of the barycenter: this allows for facilitating the loading and unloading of laundry and to recover spaces that can be advantageously utilized for the location of functional components of the laundry washing machine (7, 14, C, D).

FIG. 6 indicates, as a purely explanatory aim, a possible arrangement of the counterweights 22 and 23 on the base 20, that allows to obtain such effect.

In other possible embodiments the base 20 may be realized in cast iron, in order to constitute itself a balancing mass of the tub assembly; the lower counterweights can similarly be replaced with fixed liquid tanks at the bottom of the tub, and capable of being filled to the necessary with a quantity of water so as to allow the necessary balancing of the machine.

In the laundry washing machines according to known techniques of positioning the counterweights (forward, upper, rear, lower-forward, upper-rear), the oscillation of the tub assembly is substantially distributed towards all the directions (upper, lower, right, left), whereupon it is necessary to provide within the cabinet of the machine appropriate upper and lower free spaces.

According to the invention, the lower arrangement of counterweights allows for obtaining a very compressed steady state speed oscillation of the tub-balancing masses group; in other words, the oscillating group of the above described laundry washing machine tends to move substantially in the direction of the side walls of the cabinet of the machine; therefore the presence of high free substantial spaces are no longer necessary, but appropriate spaces will be provided at the sides of the tub assembly, which could be easily obtained by duly sizing the tub assembly (for example reducing a little the sizes, but without substantial load losses if compared with other laundry washing machines commonly in trade).

It is to be considered that, from practical tests carried out, in the machine realized according to the invention, the parallel components to the ground, of the resultant dynamic and static forces, of running and transitory, are comparable to those of a traditional machine; in other words, the breakdown of the forces on the feet of the machine (shown in 32, FIG. 4) is substantially equivalent to that of the machines according to the prior art.

As it can be understood, the functioning of the laundry washing machine according to the invention is very simple.

For the loading of clothes, the user opens the door 4, for example by way of a suitable button being present in the upper part of the cabinet 1, and raises the surface 7, in order to carry the clothes container 50. Such situation is illustrated in FIG. 3.

At this point the clothes can be introduced inside the basket 9, through the openings 11–13, something that may be carried out in very easy way, in virtue or the presence of the surface 7 and mainly of the position of the access openings of the machine and of their size; just as easy is the charging of the washing agents in the body 14, after which the flap 15 is closed (the charging of washing agents can obviously also be carried out before loading the clothes).

Once the clothes and detergent have been loaded, the user can close the door 46, initiate the washing cycle and eventually to fold away the surface 7; such situation is illustrated in FIG. 2.

As with the known techniques the washing water will be loaded up to a certain level in the tub 8 and, at an appropriate moment of the functioning cycle, the programming device of the machine will command the delivery of the washing agents through the distributor 14, for example in the ways described above. The water-detergent washing mixture flows directly between clothes contained in the basket 9 and the washing cycle proceeds in the known way, but in absence of wastes and/or accumulation of said agent on the bottom of the tub 8.

Once the washing cycle has finished, the user can unload the clothes from the machine, something that may be carried out in a simple and easy way, opening the door 4–6 and making use of the surface 7.

Just as easy is the intervention on elements C and D, in cases of periodic cleaning of the filter or of occasional maintenance interventions to the control module of the machine.

From the description the characteristics and advantages of the front loading laundry washing machine according to the present invention are clear.

As mentioned numerous variants are possible to the laundry washing machine subject of the present invention, regarding for example the shape of the door.

As previously said, even the shape of the distributor may be different from that illustrated as an example; advantageously the shapes of the body of the distributor 14 and of the glass 6 can be chosen so as to be mutually completed, also with the purpose of favoring the correct and regular movement of the laundry within the basket.

Another possible variant is that of modifying the suspension system of the base 20, for instance by providing a greater number of shock absorbers, or shock absorbers of a different shape than those illustrated herein; according to the selected suspension system, the use of springs fixed to the upper parts of the tub assembly and the upper part of the cabinet of the machine can be eliminated (as is illustrated in the case of FIG. 4).

Another variant could regard the washing agents distributor 14', that could be housed in an appropriate recess obtained in the internal part of the door as is shown in FIG. 3 in broken lines or in one of the top corners of the cabinet 1, as again can be seen in FIG. 3 illustrating diagrammatically distributor 14".

In any case it is clear that a washing agents distributor, of appropriate shape and size, could however be housed in a known way in the upper part of the machine, in the vicinity of one of the corners of the cabinet 1.

It is however clear that other variants are possible to the laundry washing machine described as an example without for this departing from the inventive idea, as it is clear that in the practical realization of the invention the various elements described can be substituted with technically equivalent elements.

We claim:

1. A front loading laundry machine, comprising:

a housing having a median horizontal plane and formed with a front side, said front side being provided with a door opening delimited by an edge, at least a substantial part of said edge extending above the median horizontal plane of said housing;

a door mounted on said front side and displaceable between closed and open positions thereof to close said opening in the closed position;

a washing chamber mounted in said housing and formed with a front wall, said wall having a chamber opening and being juxtaposed with said front side of the housing:

a laundry basket mounted in said chamber and rotatable about a horizontal axis and formed with a basket opening, the door, chamber and basket opening being aligned with one another;

balancing means for reducing vibration of the laundry machine during the rotation of said laundry basket, said balancing means and said laundry basket forming an oscillating unit;

restricting means for impeding exiting of the laundry from said basket in said open position of the door and formed on a lower edge of said chamber opening and protruding into said basket; and sealing means for preventing exit of a washing liquid from said chamber and extending between said respective openings of said basket and chamber and between said housing and restricting means.

2. The front loading laundry machine defined in claim 1, further comprising a base suspended in said housing below said laundry basket, said balancing means including a plurality of counterweights mounted on said base.

3. The front loading laundry machine defined in claim 2, further comprising a motor mounted on said base symmetrically to a vertical median plane of said housing.

4. The front loading laundry machine defined in claim 2, wherein said balancing means includes a plurality of shock absorbers extending downwardly from said base and provided with means for elastic anchoring of said shock absorbers to said housing, so that said shock absorbers are able to oscillate in a plane parallel to said horizontal median plane.

5. A front loading laundry machine, comprising:

an upright housing having a median horizontal plane and formed with a front side, said front side being provided with a door opening a substantial part of which is above the median horizontal plane of said housing;

a door mounted on said front side and displaceable between closed and open positions thereof to close said opening in the closed position;

a washing chamber mounted in said housing and formed with a front wall, said wall having a chamber opening and being juxtaposed with said front side of the housing:

a laundry basket mounted in said chamber and rotatable about a horizontal axis and formed with a basket opening, the door, chamber and basket openings being aligned with one another and being at least in substantial part above said median horizontal plane of said housing;

balancing means for reducing vibration of the laundry machine during the rotation of said laundry basket, said balancing means and said laundry basket forming an oscillating unit; and distributor means for delivering a washing agent into said basket and mounted on said front wall of said chamber and extending inwardly therefrom through a lower segment of said chamber opening into said basket.

6. The front loading machine defined in 5 wherein said distributor means is at least partially removable.

7. The front loading laundry machine defined in claim 5 further comprising access means for entering said housing and formed in said front side.

8. A front loading laundry machine, comprising:

an upright housing having a median horizontal plane and formed with a front side, said front side being provided with a door opening a substantial part of which is formed above the median plane of said housing;

a door mounted on said front side and displaceable between closed and open positions thereof to close said opening in the closed position;

a washing chamber mounted in said housing and formed with a front wall, said wall having a chamber opening and being juxtaposed with said front side of the housing;

a laundry basket mounted in said chamber and rotatable about a horizontal axis and formed with a basket opening, the door, chamber and basket openings being aligned with one another and above said median horizontal plane of said housing; and a support surface mounted on said front side below said door and swingable upwardly from a vertical rest position to a working position in which said support surface lies in a plane extending parallel to said horizontal median plane.

9. The front loading laundry machine defined in claim 8, further comprising access means for entering said housing and formed in said front side, said access means being covered by said support surface in said rest position thereof.

10. The front loading laundry machine defined in claim 8, further comprising balancing means for reducing vibration of the laundry machine during the rotation of said laundry basket, said balancing means and said laundry basket forming an oscillating unit; and a base in said housing below said laundry basket, said balancing means including a plurality of counterweights mounted on said base and a plurality of shock absorbers extending downwardly from said base and provided with means for elastic anchoring of said shock absorbers to said housing, so that said shock absorbers are able to oscillate in a respective plane parallel to said horizontal median plane.

11. The front loading machine defined in claim 10 wherein said balancing means includes a plurality of counterweights mounted on said base.

12. The front loading laundry machine defined in claim 10, further comprising a motor mounted on said base symmetrically to a vertical median plane of said housing below said basket.

13. The front loading laundry machine defined in claim 10, further comprising distribution means for distributing a washing agent into said basket and mounted on said door of said housing.

14. The front loading laundry machine defined in claim 10, further comprising distribution means for delivering a washing agent into said basket and mounted on an inner side of said front side of the housing in the vicinity of one of the corners of said housing.

15. Front loading laundry washing machine, comprising a cabinet, a washing tub housed within said cabinet, a laundry basket, arranged in the tub and rotatable around a substantially horizontal axis, the cabinet, the tub and the basket each having a front aperture for allowing the loading and unloading of the laundry, a door being provided for closing the front aperture of the cabinet, the tub and the basket, whereby said door is located in the upper half of the front side of the cabinet, below said door a support surface is articulated, which allows said support surface to be raised, from a vertical rest position, to a horizontal work position, in both said positions said door being directly in view.

* * * * *